United States Patent [19]

Hachisuka

[11] 4,289,833

[45] Sep. 15, 1981

[54] LIQUID PHASE SINTERED DENSE COMPOSITE BODY FOR BRAZED JOINTS AND METHOD FOR MAKING THE SAME

[75] Inventor: Takeji Hachisuka, Toyama, Japan

[73] Assignee: Kabushiki Kaisha Fujikoshi t/a Nachi-Fujikoshi Corp., Toyama, Japan

[21] Appl. No.: 21,976

[22] Filed: Mar. 19, 1979

[30] Foreign Application Priority Data

Mar. 31, 1978 [JP] Japan ..... 53-36697

[51] Int. Cl.[3] ..... B22F 3/00

[52] U.S. Cl. ..... 428/544; 428/545; 428/556; 428/562; 428/539.5; 428/563; 428/565; 428/564; 75/208 R; 75/DIG. 1; 75/201; 75/202; 75/203; 75/204; 75/205; 75/206; 75/229; 75/226; 75/232; 75/236; 75/242

[58] Field of Search ..... 75/208 R, DIG. 1, 226, 75/201, 202, 203, 204, 205, 206, 229, 232, 236, 242; 428/564, 556, 545, 539.5, 544, 562, 563, 565

[56] References Cited

U.S. PATENT DOCUMENTS

| | | | |
|---|---|---|---|
| 3,068,016 | 12/1962 | Dega | 75/244 |
| 3,460,920 | 8/1969 | Long et al. | 428/539.5 |
| 3,889,348 | 6/1975 | Lemelson | 428/539.5 |

*Primary Examiner*—Brooks H. Hunt
*Attorney, Agent, or Firm*—Spencer & Kaye

[57] ABSTRACT

A liquid phase sintered body for brazed joints having a multiplicity of pores, grooves and/or indented patterns formed on a desired surface. The liquid phase sintered body is produced by a method comprising the steps of forming a compact body of a mixture of a hard refractory material, such as carbides, nitrides, oxides, borides and silicides mixed with cementing metal in powder form, placing on the desired surface any one of coarse grains, strands or plates of a metal having a diameter or a thickness over ten times as great as the grain size of the cementing metal, and sintering the compact body under conditions suitable for melting the coarse grains, strands and/or mesh of strands or plates after densification of the compact body has been completed or substantially completed. The metal forming the coarse grains, strands or plates must have a melting point which is more than 50° C. higher than the temperature at which the cementing metal in powder form melts, good wettability with respect to the hard refractory material and excellent properties as a cementing metal.

The sintered body thus prepared by liquid phase sintering has a multiplicity of pores, grooves and/or indented patterns at a portion where the coarse grains, strands or mesh of strands or plates have been placed and is highly suitable for joining to a base metal by means of brazing.

21 Claims, 3 Drawing Figures

×25

LIQUID PHASE SINTERED DENSE COMPOSITE BODY FOR BRAZED JOINTS AND METHOD FOR MAKING THE SAME

1. BACKGROUND OF THE INVENTION

This invention relates to liquid phase sintered dense composite bodies of an alloy or alloys typified by cemented hard metals or cermets wherein refractory hard material such as carbides, nitrides, oxides, borides and silicides are cemented with metals and/or alloys and also to a method for manufacturing the same. More particularly, this invention relates to a dense sintered body of the type described which is formed with pores or grooves on a specific surface or surfaces thereof and a method for producing such dense sintered body. The metal referred to herein includes a pure metal or metals and an alloy or alloys.

A sintered body of a liquid phase sintered composite is produced by cementing hard refractory material with a metal or metals. Typical examples of such a liquid phase sintered body are a cemented hard metal produced by cementing its principal component, namely tungsten carbide with a cobalt metal and a cermet produced by cementing its principal component such as titanium carbide with a nickel metal. Generally, technical difficulties have been encountered in producing such a sintered body when the body has a complex shape, and such composite materials have also been expensive. Therefore, when cutting tools, wear resistant parts and machine parts of a complex shape or a large size are required, it has hitherto been customary to mechanically or physically affix, or to join by brazing, a small sintered body having a relatively simple shape to a base metal, such as steel, to thereby obtain the desired product.

Generally, a hard refractory material has a thermal expansion coefficient which is considerably lower than that of steel or other base metals. Accordingly, the thermal expansion coefficient of a sintered body is generally low and equal to or below one half that of steel. Thus, when a sintered body is joined by brazing to a base metal, stress and strain are likely to be generated in the interface betwen the sintered body and the base metal and in its vicinity, due to the difference in thermal expansion coefficient, and tensile stress is applied to the opposite surface of the sintered body. The stress and strain generated and applied by brazing lowers the strength of the sintered body, with the result that chipping or cracking tends to occur while the sintered body is being ground or placed in service.

In order to avoid or reduce the stress and strain generated by brazing and minimize any reduction in the strength of the sintered body, various proposals have been made. One such method consists of using a brazing alloy having a low melting point or of using a copper plate to effect sandwich brazing. However, no method which completely solves this problem has yet been developed. It is interesting to note that a TiC-Ni-Mo cermet is not used to produce a tool to be brazed, in spite of the fact that the cermets themselves can be used, as a cutting tool, in substantially the same applications as a cemented hard metal. The reason for this is that a reduction in strength that would be caused by brazing markedly reduces its adaptability as a material for producing a tool.

In producing a liquid phase sintered dense composite, it is a general practice to use a cementing metal in the form of a fine powder with a grain size of from less than 1 μm to several μm so as to facilitate densification of a compact body in the process of sintering and to impart optimum properties to the sintered body thus produced. After the cementing metal in powder form is uniformly mixed with hard refractory material, the mixture is molded into a compact body. In the process of heating the compact body to a sintering temperature and holding the same at the sintering temperature, the cementing metal is melted and the surface tension of the molten cementing metal causes the compact body to rapidly contract, thereby densifying the compact body. The transformation of the cementing metal into a liquid phase will be discussed more in detail. In the process of heating a compact body to a sintering temperature and holding the same at the sintering temperature, the elements constituting the hard refractory material which is in contact with the cementing metal first diffuse in the solid state into the cementing metal. This diffusion of the elements in the solid state into the cementing metal causes a change in the composition of the cementing metal and lowering of the melting point thereof. If the cementing metal forms a eutectic alloy with the diffused elements, then the cementing metal will melt when heated to a temperature above the eutectic temperature, thereby promoting densification of the compact body. This is a well-known fact.

In cemented hard metals of the WC-Co system, for example, the melting point of cobalt metal is 1495° C. However, the eutectic temperature of the cementing metal of these cemented hard metals is about 1280° C., so that sintering of the compact bodies of the mixture of hard refractory material and metal for cementing generally takes place in a temperature range of 1350° to 1450° C. which is an intermediate temperature between the melting point of the cobalt metal and the eutectic temperature of the cementing metal. In cermets of the TiC-Ni-Mo system, the eutectic temperature of the metallic components for cementing is about 1270° C. and sintering usually takes place at less than 1455° C. which is the melting point of nickel metal.

As mentioned above, when sintered bodies are produced, the sintering temperature is generally lower than the melting point of the cementing metal. In this case, the time required for the cementing metal to melt and for the transformation thereof into a liquid phase to occur at the sintering temperature in the heating process is governed by a change in the composition of the cementing metal due to diffusion in the solid state of the elements of the hard refractory material. Thus, the time required may vary depending on the manner in which the raw material powders are mixed with each other, the state of contact between the raw material powders, and the grain size of the cementing metal.

SUMMARY OF THE INVENTION

An object of the present invention is to solve the aforementioned problems encountered in joining a sintered body of a liquid phase sintered composite material of the prior art by way of brazing to a base metal, by providing a novel dense sintered body of the type described which is formed with a multiplicity of patterned areas consisting of pores, grooves and/or indented patterns on a specific surface thereof. It is also an object of this invention to provide a method for producing such a sintered body.

Another object of the present invention is to provide a novel dense sintered body of a liquid phase sintered composite which is formed with a multiplicity of pores, grooves and or indented patterns on a surface thereof at which the sintered body is joined to a base metal by brazing. It is a further object to provide a method for producing such sintered body, by utilizing the facts that in a liquid phase sintered composite body the melting point of the cementing metal is lowered by the diffusion in the solid state of the elements constituting the hard refractory material, and that the time required for the transformation of the cementing metal into a liquid phase to occur may vary depending on the grain size of the cementing metal.

According to the present invention, metallic elements consisting of any one of coarse grains, strands or a mesh of plates or strands of the same metal as used for cementing and having a diameter or a thickness over ten times as large as the grain size of a cementing metal which form a mixture with a hard refractory material, such as a metal carbide compound, is placed on a specific surface of a compact body of the mixture formed by pressing. The compact body is then sintered by heating to a temperature range which is higher than the temperature, such as the eutectic temperature, at which the cementing metal is transformed into a liquid state but lower than the melting point of the cementing metal. As the cementing metal melts and the compact body is rapidly densified, only the surface of the coarse grains, strands or plates melt simultaneously with the cementing metal whereas the interior of the coarse grains, strands or plates still remain in the solid state because diffusion of the elements of the hard refractory material into the metal does not progress sufficiently to change the composition of the metal to allow transformation thereof into a liquid state to occur at the prevailing temperature. Further heating of the compact body results in diffusion of the elements of the hard refractory material into the interior portion of the coarse grains, strands or cut mesh of strands or plates until finally the coarse grains or strands or mesh of strands or plates are melted.

According to another aspect of the invention, a metal having a melting point higher by at least 50° C. than the temperature at which the transformation of the cementing metal into the liquid state occurs may be used for forming the coarse grains, strands or plates to be placed on a specific surface of a compact body of the mixture of hard refractory material and cementing metal. When such metal is used, the coarse grains, strands or plates can be made to melt after densification of the compact body to be sintered has been completed or substantially completed, by adjusting the diameter or thickness of the coarse grains, strands or plates and the sintering conditions including the rate at which the temperature is increased in heating the compact body. Part of the molten metal remains in the vicinity of its original position to locally form a composition containing a large amount of the cementing metal. However, the majority of the molten metal spreads to the entirety of the surface of the sintered body to form a thin metallic surface layer in which pores or grooves are formed in positions in which the coarse grains, strands or plates have originally existed. The formation of the thin metallic surface layer by the molten metal after completion of densification of the sintered body enables the bonding of the sintered body to a base metal or alloy to be effected satisfactorily by brazing, thereby increasing bonding strength. Thus the sintered body according to the invention has particular utility as a tip for brazed joints. The aforementioned effect is particularly noteworthy in the case of a liquid phase sintered dense composite body, such as cemented hard metals containing a large amount of titanium carbide or cermets including titanium carbide as its principal component, in which the principal component or the hard refractory material has low joining strength with respect to a brazing alloy. Also, the formation of the pores or grooves on the surface of the sintered body at which the latter is joined by brazing to a base metal has the effect of dividing the stress and strain produced on the brazed surface. When the sintered body according to the present invention is joined by brazing to a base metal, the brazing alloy readily fills the pores indented patterns, or grooves upon melting, thereby increasing the area of jointing formed by brazing. Thus, the sintered body according to the present invention can achieve the important and distinguishable effects of increasing the strength of the joints formed by brazing and absorbing the strain produced by brazing.

DESCRIPTION OF THE EMBODIMENTS

The embodiments of the invention will now be described by referring to examples shown in the accompanying drawings which show the sintered dense composite body produced by the method according to the invention.

EXAMPLE 1

A mesh of pure nickel metal strands of 30 mesh, the strands having a diameter of 0.3 mm, was cut into a square with a side of 12 mm which was annealed by heating at 900° C. for one hour in a hydrogen atmosphere and then gradually cooled. The square mesh of nickel metal strands thus prepared was placed on an upper portion of a lower punch of a die set of square shape with a side of 15 mm, and a predetermined amount of a powder mixture for the composition by weight percent of 76% TiC-11% Ni-13% Mo prepared by the usual method was charged into a die cavity. The charge was compacted under a pressure of 2 ton/cm$^2$ to produce a compact body of 5 mm in thickness. After having been subjected to pre-sintering at 600° C. for one hour, the compact body was sintered by increasing the temperature from 900° to 1300° C. at a rate of 15° C./min and holding the compact body for one hour under vacuum.

Figure 1:
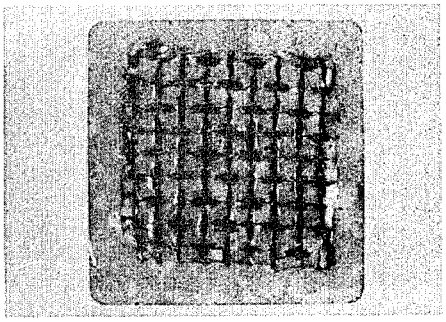
FIG. 1 is a photograph of the sintered body according to the present invention, showing mesh-like grooves opening to the outside formed in portions of the sintered body obtained in Example 1 in which a nickel mesh of strands was present before sintering.

The dense sintered body produced by the aforesaid method was formed with open cavities, as shown in FIG. 1, in portions thereof where the nickel strands of the mesh were present, with mesh-like grooves being visible. Studies of the microstructure of a section of the sintered body and the distribution of hardness therein have shown that, although a nickel metal surface layer was formed with some thickness over the surfaces of the grooves, there was no appreciable observable change in the microstructure and hardness of the sintered body in the vicinity of the grooves, and the observations were normal. From these findings, it has been concluded that the nickel metal strands of the mesh were melted after densification of the sintered body has been completed, and that the majority of the molten nickel metal spread over the surface of the sintered body to form a metallic surface layer, thus resulting in formation of an indented pattern in portions of the sintered body in which the nickel metal strands of the mesh were present and subsequently formed pattern of indented grooves.

The sintered body produced by the method according to the invention was joined by brazing, at the surface thereof on which the mesh-like grooves are present, to a steel member of 10 mm in thickness, by using a brazing alloy containing silver. After having been brazed to the steel member, a section of the sintered body was examined and it was found that the grooves were filled with the brazing alloy. The sintered body brazed to the steel member was ground by using a grinding wheel of green corundum under severe conditions to examine whether cracking had been caused by grinding. The results show that cracks are hard to develop in the sintered body produced by the method according to this invention, as compared with sintered bodies of the prior art which lack grooves on their surfaces. Thus, it has been ascertained that the sintered body according to the present invention has superb properties as a sintered body for brazing. It is believed that the excellent quality of the sintered body according to the present invention can be attributed to the synergistic effects of the stress produced by brazing being broken down by the grooves while the produced stress is primarily absorbed as strain by the brazing alloy introduced into the grooves, and of the residual stress remaining in the vicinity of the brazed surface of complex shape without exerting any influence on the opposite surface of the sintered body.

EXAMPLE 2

To a powder mixture of the composition by weight percent of 94% WC-6% Co prepared by the usual method was added a cobalt metal in globular coarse grains of 60 to 100 mesh, in a proportion of 10 weight percent with respect to the powder mixture. The mixture was thoroughly mixed manually by using a mortar. 1 g of the powder mixture was charged uniformly into a square die set with a side of 15 mm, and then a predetermined amount of the powder mixture of 94% WC-6% Co was charged into the die set. A pressure of 1 ton/cm$^2$ was applied to the charge in the die set to produce a compact body of 5 mm in thickness. After having been subjected to pre-sintering at a temperature of 600° C. for one hour, the compact body was sintered by raising the temperature at a rate of 15° C./min from 600° to 1400° C. and holding the sintered compact body for one and a half hours under vacuum.

Figure 2:
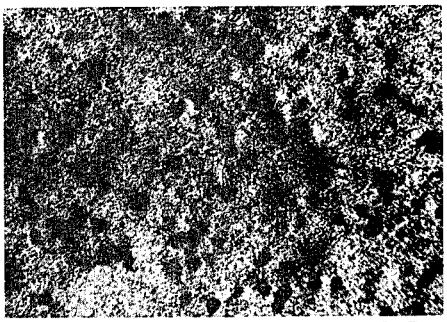
FIG. 2 is a photograph (X25) of the sintered body according to the present invention, showing pores opening to the outside formed in portions of the sintered body obtained in Example 2 in which globular coarse grains of nickel metal existed before sintering.

The dense sintered body produced by the aforesaid method was formed with a multiplicity of pores, as shown in FIG. 2, which were disposed on the surface of the sintered body.

EXAMPLE 3

Figure 3:
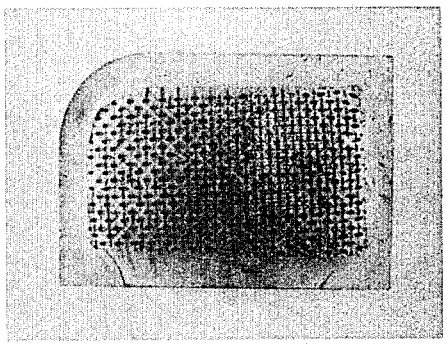
FIG. 3 is a photograph of the sintered body according to the present invention, showing mesh-like grooves opening to the outside formed in portions of the sintered body obtained in Example 3 in which a nickel mesh of strands was present before sintering.

A mesh of 50 mesh of pure nickel metal strands having a diameter of 0.2 mm, was subjected to annealing at 900° C. in the same manner as described in Example 1. After placing the nickel strand mesh on a lower punch of a die set for forming a standard cutting tool in accordance with the JIS (Japanese Industrial Standards) 01-3 model, a powder mixture of the composition by weight percent of 75% TiC-15% Ni-10% Mo prepared by the usual method was charged into the die cavity, and a pressure of 2 ton/cm$^2$ was applied to the charge in the die set to produce a compact body. After having been subjected to pre-sintering at 900° C. for one hour in a hydrogen atmosphere, the pre-sintered compact body was sintered in a vacuum furnace by raising the temperature from 600° to 1300° C. at a rate of 12° C./min and by holding the compact body at a vacuum of $10^{-4}$ mmHg for one and a half hours. The sintered body produced by the aforesaid method was a dense sintered body having a normal microstructure and hardness, and grooves in the form of a mesh were observed, as shown in FIG. 3, in portions of the sintered body in which the nickel metal strands of the mesh were present.

The sintered body produced by this method was joined by brazing, at the surface thereof on which the grooves were formed, to a base metal by using a brazing alloy containing silver, to produce a standard type cutting tool. Tests on cutting the outer circumference of bars were conducted by using the standard cutting tool incorporating therein the sintered body according to the present invention and a throw-away insert of the same composition as the sintered body, under the following cutting conditions:

Material to be machined: JIS SKH55 (Brinell hardness, 260)

Dimensions of the material to be machined: 45 mm (diameter)×250 mm

Cutting Speed: 100 m/min

Depth of Cut: 1.5 mm

Feed: 0.13 mm/rev

Shape of the Tools: Front Top Rake, 5°; Side Rake, 5°; Front Clearance, 5°; Side Clearance, 5°; End-Cutting-Edge Angle, 15°; Side-Cutting Edge Angle, 15°; Radius of Nose, 1.2 mm.

In the tests, the average number of pieces produced by cutting was obtained for each test piece until the end of the service life was reached.

The results of the tests show that whereas the throw-away insert reached the end of its service life after cutting five pieces, the cutting tool incorporating therein the sintered body according to the present invention was capable of cutting eight pieces until its service life came to an end. In either case, the service life of the tool came to an end due to wear. From this fact, it will be evident that the use of the sintered body according to the invention eliminates the reduction in resistance to chipping which has occured in sintered bodies of the prior art due to brazing.

EXAMPLE 4

To a powder mixture of the composition by weight percent of 30% TiC-46% WC-10% TaC-12% Ni-2% Mo was added a nickel metal in globular coarse grains of 60 to 80 mesh, in a proportion of 20 weight percent with respect to the powder mixture. The mixture was thoroughly mixed manually by using a mortar, and 0.2 g/cm$^2$ of the powder mixture was charged uniformly into a die set, and then a predetermined amount of the powder mixture of 30% TiC-46% WC-10% TaC-12% Ni-2% Mo was charged into the die set. A pressure of 1 ton/cm$^2$ was applied to the charge in the die set to produce a compact body of the plate-shape with a thickness of 5 mm. After having subjected to pre-sintering by the usual method, the compact body was sintered at 1400° C. for two hours under vacuum, to produce a dense sintered body formed on only a specific surface thereof with a multiplicity of pores opening to the outside.

Side-cutters each with twelve cutting edges were produced by using the sintered body according to the invention and a sintered body of the prior art, and a chromium molybdenum steel of Japanese Industrial Standards of SCM 4 material (Brinell hardness, 300) was subjected to downhand cutting at a feed rate of 640 mm/min and a cutting length of 1.28 m by using the two types of side-cutters, to investigate the relation between the cutting speed and the chipping in the cutting edges.

When a sintered body of the prior art was joined to a base metal by brazing, chipping occurred in the cutting edge at a cutting speed of 150 m/min. However, no chipping in the cutting edge was observed at a cutting speed of 300 m/min with the cutter incorporating therein the sintered body according to the invention joined by brazing. In view of this finding, it will be evident that the present invention offers the advantage of eliminating the reduction in resistance to chipping, caused by intermittent cutting, which is observed in sintered bodies of the prior art.

EXAMPLE 5

To a powder mixture of the composition by weight percent of 70% TiC-20% Ni-10% Mo was added type AISI 410L stainless steel in coarse grains of 60 to 100 mesh, in a proportion of 20 weight percent with respect to the powder mixture. The mixture was thoroughly mixed and treated in the same manner as described in Examples 2 and 4. The product obtained was a sintered body formed with a multiplicity of pores on the brazing surface. An alloy used as a cementing metal may include a stainless steel and a nickel base alloy, for example.

The examples of the invention have been described hereinabove. In the present invention, coarse grains, strands or a plates of a metal are used. The metal forming such coarse grains, strands or plates need not be the same metal as the cementing metal used for cementing the hard refractory material. Any metal may be used so long as it has a melting point by 50° C. or more higher than the temperature at which the transformation of the cementing metal into a liquid state occurs, good wettability with respect to the hard refractory material and a suitable function as a cementing metal. It is apparent from the mechanism described in the summary of the invention that such metal can achieve the same or similar results as the cementing metal.

The reason why the diameter or thickness of coarse grains, strands or plates is limited to over ten times as great as the grain size of the cementing metal in powder form is as follows.

If the coarse grains, strands or plates had a diameter or a thickness smaller than this value, it would be impossible in actual practice to cause the coarse grains, strands or plates in the sintered body to melt after solidification of the sintered body has been completed or substantially completed, in view of the rate of diffusion of the elements of the hard refractory material into the cementing metal under the state that transformation of the cementing metal into a liquid state has occurred. If the coarse grains, strands or plates were melted before densification has progressed satisfactorily, the molten metal would spread to the entirety of the sintered body, with the result that the composition and nature of the sintered body produced would essential, be altered. The reason why the metal for forming the coarse grains, strands or plates should have a melting point over 50° C. higher than the temperature at which the transformation of the cementing metal into a liquid phase occurs is that if the temperature difference is less than 50° C., it is technically impossible, as has been ascertained, to cause the coarse grains, strands or plates to melt after densification of the sintered body has been completed or substantially completed.

What is claimed is:

1. A liquid phase sintered dense composite metal body comprising:

a metal base layer formed by a powder mixture of at least one cementing metal and at least one hard refractory metal carbide compound, said base layer including a multiplicity of unmelted particles of said hard refractory metal carbide compound dispersed within said metal base layer; and a matrix layer consisting essentially of said cementing metal and a portion of said metal carbide compound diffused into said cementing metal, said matrix layer tightly cementing the unmelted particles of said hard refractory metal carbide compound; and a continuous metal surface layer covering an entire surface of said metal base layer, said continuous metal surface layer having a chemical composition similar to that of said cementing metal, said continuous metal surface layer including a plurality of patterned areas formed by a first plurality of metallic elements partially embedded in the surface of said metal base layer, said first plurality of metallic elements having melted and then solidified at predetermined locations in said continuous metal surface layer; and a thin surface layer contiguously integral with all of said plurality of patterned areas, said thin surface layer being formed by the fusing together of a second plurality of said metallic elements, said metallic elements having melted and spreadingly flowed outward from said predetermined locations to cover said metal base layer.

2. A liquid phase sintered dense composite metal body as claimed in claim 1, wherein said continuous metal surface layer and said cementing metal have the same chemical composition.

3. A liquid phase sintered dense composite metal body as claimed in claim 1, wherein said continuous metal surface layer and said cementing metal have different chemical compositions, said continuous metal surface layer being effective as a cementing metal, having a melting point which is at least 50° C. higher than the temperature at which the cementing metal transforms into a liquid state and having good wettability to said hard refractory metal carbide compound.

4. A liquid phase sintered dense composite metal body as claimed in claim 1, wherein said hard refractory metal carbide compound is selected from the group consisting of TiC, WC and TaC, said cementing metal is selected from the group consisting of Ni, Co and Fe, and the continuous metal surface layer is selected from the group consisting of Ni, Co and Fe.

5. A liquid phase sintered dense composite metal body as claimed in claim 4, wherein said metal base layer is composed by weight of a hard refractory compound consisting essentially of about 76 percent TiC and a cementing metal consisting essentially of about 11 percent Ni; and wherein said patterned areas comprise indented grooves of a mesh-like configuration formed on the surface of said metal base layer, said continuous metal surface layer including the surfaces of said indented grooves being composed of Ni.

6. A liquid phase sintered dense composite metal body as claimed in claim 4, wherein said metal base layer is composed by weight of a hard refractory compound consisting essentially of about 94% WC and a cementing metal consisting essentially of about 6% Co; and wherein said patterned areas comprise a multiplicity of open pores, said continuous metal surface layer including the surfaces of said open pores being composed of Co.

7. A liquid phase sintered dense composite metal body as claimed in claim 4, wherein said metal base layer is composed by weight of a hard refractory compound consisting essentially of about 75% TiC and a cementing metal consisting essentially of about 15% Ni and 10% Mo; and wherein said patterned areas comprise indented grooves of a mesh-like configuration formed on the surface of said metal base layer said continuous metal surface layer including the surfaces of said indented grooves being composed of Ni.

8. A liquid phase sintered dense composite metal body as claimed in claim 4, wherein said metal base layer is composed by weight of a hard refractory compound consisting essentially of about 30% TiC, 46% WC and 10% TaC and a cementing metal consisting essentially of about 12% Ni and 2% Mo; and wherein said patterned areas comprise a multiplicity of open pores, said continuous metal surface layer including the surfaces of said open pores being composed of Ni.

9. A liquid phase sintered dense composite metal body as claimed in claim 1, wherein said metal base layer is comprised by weight of a hard refractory compound consisting essentially of about 70% TiC and a cementing metal consisting essentially of about 20% Ni and 10% Mo; and wherein said patterned areas comprise indented grooves of a mesh-like configuration formed on the surface of said metal base layer, said continuous metal surface layer including the surfaces of said indented grooves being comprised of type AISI 410 stainless steel.

10. A liquid phase sintered dense composite metal body as claimed in claim 1, wherein said metallic elements are in the form of at least one of coarse grains, strands and plates.

11. A liquid phase sintered dense composite metal body as claimed in claim 1 or 10 wherein said patterned areas are in the form of at least one of pores, grooves and indented mesh-like patterns.

12. A method of making a liquid phase sintered composite metal body having patterned areas on a surface thereof, said method comprising the steps of:

preparing a powder mixture consisting essentially of at least one powdered hard refractory metal carbide compound admixed with at least one powdered cementing metal component;

preparing a plurality of metallic elements having thicknesses at least 10 times greater than the grain size of said powdered cementing metal component and a chemical composition similar to that of said cementing metal component, said metallic elements being effective as a cementing metal, having melting points which are at least 50° C. higher than the temperature at which the cementing metal transforms into a liquid state and having good wettability to said hard refractory metal carbide compound;

combining said plurality of metallic elements with said powder mixture and compacting them together such that said metallic elements are placed on and partly embedded in a surface of said compacted powder mixture; and sintering said compact body to effect liquid phase sintering whereby said hard refractory metal carbide compound is cemented by said cementing metal component, and said metallic elements are melted to form a continuous surface metal layer having at least one of open pores, grooves and indented mesh-like patterns at predetermined locations on said surface of said compacted powder mixture and spread as a thin surface layer over the entirety of said surface including the surfaces of said pores, grooves and indented patterns.

13. A method of making a liquid phase sintered composite metal body as claimed in claim 12, wherein said metallic elements are made of a metal which is the same as said cementing metal component.

14. A method of making a liquid phase sintered composite metal body as claimed in claim 12, wherein said metallic elements are made of a metal which is different from said cementing metal component.

15. A method of making a liquid phase sintered dense composite metal body as claimed in claim 12, wherein said powder mixture consists of at least one hard refractory metal carbide compound selected from the group consisting of TiC, WC and TaC and said cementing metal compound is selected from the group consisting of Ni, Co, Mo and Fe; and said metallic elements are selected from the group consisting of Ni, Co and Fe.

16. A method of making a liquid phase sintered dense composite metal body as claimed in claim 15, wherein said powder mixture is composed by weight of a hard refractory compound consisting essentially of about 76% TiC and a cementing metal component consisting essentially of about 11% Ni and 13% Mo; and wherein said metallic elements are in the form of a cut mesh of pure Ni strands, said strands forming during the sintering step said indented mesh-like patterns.

17. A method of making a liquid phase sintered composite metal body as claimed in claim 15, wherein said powder mixture is composed by weight of a hard refractory compound consisting essentially of about 94% WC and a cementing metal component consisting essentially of about 6% Co; and wherein said metallic elements are in the form of coarse spherical grains of Co of 60–100 mesh, said grains forming during the sintering step open pores in said continuous surface metal layer.

18. A method of making a liquid phase sintered dense composite metal body as claimed in claim 15, wherein said powder mixture is composed by weight of a hard refractory compound consisting essentially of about 75% TiC and a cementing metal component consisting essentially of about 15% Ni and 10% Mo; and wherein said metallic elements are in the form of a cut mesh of pure Ni strands, said strands forming during the sintering step said indented mesh-like patterns.

19. A method of making a liquid phase sintered dense composite metal body as claimed in claim 15, wherein said powder mixture is composed by weight of a hard refractory compound consisting essentially of about 30% TiC, 46% WC and 10% TaC and a cementing metal component consisting essentially of about 12% Ni and 2% Mo; and wherein said metallic elements are in the form of coarse grains of Ni of 60–80 mesh, said grains forming during the sintering step open pores in said continuous metal surface layer.

20. A method of making a liquid phase sintered dense composite metal body as claimed in claim 15, wherein said powder mixture is composed by weight of a hard refractory compound consisting essentially of about 70% TiC and a cementing metal component consisting essentially of about 20% Ni and 10% Mo; and wherein said metallic elements are in the form of coarse grains of type AISI 410L stainless steel, said grains forming open pores during the sintering step in said continuous metal surface layer.

21. A method of making a liquid phase sintered dense composite metal body as claimed in claim 12, wherein said metallic elements are in the form of at least one of coarse grains, strands and plates.

* * * * *